US011794309B2

(12) United States Patent
Gray et al.

(10) Patent No.: US 11,794,309 B2
(45) Date of Patent: Oct. 24, 2023

(54) AUTOMATED SMART VISE SYSTEM

(71) Applicant: Hurco Companies, Inc., Indianapolis, IN (US)

(72) Inventors: Paul J. Gray, Zionsville, IN (US); Matthew H. Tinkle, Indianapolis, IN (US); David G. Coffman, Frankfort, IN (US); Donald J. Hammer, Avon, IN (US)

(73) Assignee: Hurco Companies, Inc., Indianapolis, IN (US)

( * ) Notice: Subject to any disclaimer, the term of this patent is extended or adjusted under 35 U.S.C. 154(b) by 249 days.

(21) Appl. No.: 17/132,826

(22) Filed: Dec. 23, 2020

(65) Prior Publication Data

US 2021/0268628 A1 Sep. 2, 2021

Related U.S. Application Data

(60) Provisional application No. 62/983,199, filed on Feb. 28, 2020.

(51) Int. Cl.

| | |
|---|---|
| ***B25B 1/10*** | (2006.01) |
| ***B25B 1/02*** | (2006.01) |
| ***B25B 1/24*** | (2006.01) |

(52) U.S. Cl.

CPC ..... *B25B 1/10* (2013.01); *B25B 1/02* (2013.01); *B25B 1/24* (2013.01)

(58) Field of Classification Search

CPC .. B25B 1/10; B25B 1/02; B25B 1/103; B25B 1/18; B25B 1/24

See application file for complete search history.

(56) References Cited

U.S. PATENT DOCUMENTS

| | | | | |
|---|---|---|---|---|
| 4,812,731 A * | 3/1989 | Lovrenich | ..... | B25B 1/18 318/592 |
| 4,906,926 A * | 3/1990 | Rogacki | ..... | H03K 17/9547 901/46 |
| 2014/0184106 A1 | 7/2014 | Kroell et al. | | |

FOREIGN PATENT DOCUMENTS

| | | | | |
|---|---|---|---|---|
| DE | 1171349 B * | 5/1964 | | |
| DE | 1171349 B | 5/1964 | | |
| DE | 3309513 A1 | 10/1983 | | |
| DE | 3309513 A1 * | 9/1992 | | |
| DE | 102015117288 A1 * | 4/2017 | ..... | B23Q 16/023 |
| DE | 102015117288 A1 | 4/2017 | | |

(Continued)

OTHER PUBLICATIONS

Giovanni Gastaldo; Vice; Sep. 24, 1992; EPO English Machine Translation; pp. 1-8 (Year: 2023).*

(Continued)

*Primary Examiner* — Bayan Salone

(74) *Attorney, Agent, or Firm* — Faegre Drinker Biddle & Reath LLP

(57) ABSTRACT

An automated vise is disclosed. A gross moveable jaw drive has a stroke longer than the stroke of a fine moveable jaw drive. With this construction, the gross moveable jaw drive can be utilized to actuate the one or more moveable jaws of the vise over a distance greater than the fine moveable jaw drive stroke to a position in which actuation of the fine moveable jaw drive is capable of positioning the one or more moveable jaws in a clamp position to apply pressure to hold the workpiece for machining by, e.g., a CNC machine. In this way, the automated vise can account for workpieces of differing size.

18 Claims, 11 Drawing Sheets

(56) References Cited

FOREIGN PATENT DOCUMENTS

DE 102018108478 A1 * 10/2019
DE 102018108478 A1 10/2019

OTHER PUBLICATIONS

Abele Eberhard et al.; Gripper Device And Method For Gripping And Frictionally Clamping A Workpiece; Apr. 13, 2017; EPO English Machine Translation; pp. 1-8 (Year: 2023).*
European search report dated Nov. 22, 2021 for EP Application No. 21159126.

* cited by examiner

AUTOMATED SMART VISE SYSTEM

CROSS-REFERENCE TO RELATED APPLICATION

This application claims the benefit of U.S. Provisional Patent Application No. 62/983,199, filed Feb. 28, 2020, the entire disclosure of which is expressly incorporated by reference herein.

FIELD OF THE INVENTION

The invention relates to a vise and, more particularly, to an automated vise for holding workpieces during manufacturing runs utilizing a shaping machine such as a Computer Numerical Control ("CNC") machine.

BACKGROUND/SUMMARY

CNC automation systems rely on remote actuated vises to hold a workpiece in place during cutting operations. Certain vises create high clamping forces using pneumatic or hydraulic pressure exerted either through one moving jaw or through both jaws using input/output ("I/O") signals from, e.g., a robot system used to load workpieces into the CNC machine for subsequent forming processing. The stroke of the jaws with these systems is typically small (i.e., no more than about 6 millimeters ("mm")).

During certain manufacturing runs, a single CNC machine will be used to shape workpieces of different initial sizes. If the workpiece dimension to be clamped by the vise (i.e., a workpiece dimension along a particular trajectory, e.g., coincident with or parallel to one of the three axes of a standard Cartesian coordinate system defined within the workpiece—hereinafter, "clamp dimension" will be used at times as a shorthand for this dimension) differs by more than the stroke of the jaws of the vise, then the aforementioned vise cannot be utilized to automatically effect holding of the disparately sized workpieces during the manufacturing run. To clamp such differently sized workpieces during such a run, an operator must halt production to mechanically loosen and move the moveable vise jaw(s) to position the moveable vise jaw(s) to be able to hold the workpiece within the stroke of the jaws.

With this vise design, there is no way to automatically adjust the vise to accommodate workpieces having differing clamp dimensions in an automation system using the same vise to hold the different workpieces. To automate production of batches of high-mixes of workpieces would require multiple vises on the machine tool's table covering the range of sizes of workpieces to be machined (FIG. 1) or to exchange out the vises using, e.g., a robotic system (see, e.g., FIGS. 2A, 2B, and 2C). Both scenarios require multiple vises to be preset to the various sizes of parts to be produced prior to starting the automation system. This can be very expensive and requires manual labor to intervene and plan the sequence for the production system. In a production environment that has a very high mix of part sizes to produce, it may not be feasible to produce the parts through automation due to the limitation of one-size setting of these vise systems.

The present disclosure provides a vise capable of automatically (i.e., without human intervention) holding a number of workpieces having disparate clamp dimensions.

In an exemplification thereof, the present disclosure provides a vise for holding a workpiece in a forming machine, comprising: a moveable jaw moveable between an open position and a clamp position, whereby the moveable jaw allows a workpiece to be positioned in the vise in the open position and the moveable jaw clamps the workpiece in the vise in the clamp position; a gross moveable jaw drive connected to the moveable jaw and operable to actuate the moveable jaw between the open position and the clamp position, the gross moveable jaw drive comprising a lock selectively restricting a movement of the moveable jaw toward the open position; and a fine moveable jaw drive connected to the moveable jaw and operable to actuate the moveable jaw between the open position and the clamp position, whereby the gross moveable jaw drive is operable to actuate the moveable jaw to a near clamp position and the fine moveable jaw drive is operable to actuate the moveable jaw from the near clamp position to the clamp position to hold the workpiece during a forming operation.

In certain alternative forms of the exemplifications of the disclosure, the lock is moveable between an unlock position allowing the gross moveable jaw drive to actuate the moveable jaw between the open position and the clamp position, and a lock position restricting a movement of the moveable jaw toward the open position within one of a plurality of gross increments; and the fine moveable jaw drive is operable to actuate the moveable jaw within one of the plurality of gross increments.

In further alternative forms of the exemplifications of the disclosure, the gross moveable jaw drive comprises a drive screw and the lock comprises an inefficiency in the drive screw, whereby the inefficiency in the drive screw prevents back-driving of the gross moveable jaw drive to restrict a movement of the moveable jaw toward the open position.

In further alternative forms of the exemplifications of the disclosure, the fine moveable jaw drive comprises a pneumatic moveable jaw drive or a hydraulic moveable jaw drive.

In further alternative forms of the exemplifications of the disclosure, the gross moveable jaw drive comprises a drive gear. In alternatives, the lock restricts movement of the drive gear in the lock position.

In additional alternative forms of the exemplifications of the disclosure, the vise further comprises a controller communicatively connected to the gross moveable jaw drive to allow the controller to control an actuation of the gross moveable jaw drive. In alternatives, the vice further comprises a proximity sensor positioned to detect a preset position of the moveable jaw relative to the workpiece, the proximity sensor communicatively connected to the controller, the controller ceasing actuation of the gross moveable jaw drive if the proximity sensor detects the preset position of the moveable jaw relative to the workpiece. In additional alternatives, the vise further comprises a motor sensor operable detect the when the moveable jaw has contacted the workpiece. In alternatives, the motor sensor comprises: a motor load sensor operable to detect a motor load, the motor load sensor communicatively connected to the controller, the controller ceasing actuation of the gross moveable jaw drive if the motor load sensor detects that the moveable jaw has contacted the workpiece. In further alternatives, the vice further comprises an input communicatively connected to the controller, the controller configured to receive via the input a workpiece dimension to be clamped by the vise, the controller ceasing actuation of the gross moveable jaw drive when the moveable jaw reaches the near clamp position, whereby the fine moveable jaw drive is operable to actuate the moveable jaw from the near clamp position to the clamp position to hold the workpiece during a forming operation.

In further alternative forms of the exemplifications of the disclosure, the moveable jaw comprises a moveable jaw assembly comprising a moveable jaw carriage and a moveable jaw moveable by the fine moveable jaw drive relative to the moveable jaw carriage, the lock operable to restrict movement of the moveable jaw carriage while movement of the moveable jaw relative to the moveable jaw carriage via the fine moveable jaw drive is still allowed.

In additional forms of the exemplifications of the disclosure, the gross moveable jaw drive comprises a drive gear having a plurality of teeth, and wherein the lock comprises a pawl moveable into locking engagement with the plurality of teeth.

In further alternative forms of the exemplifications of the disclosure, the lock comprises a torque coupling.

In additional forms of the exemplifications of the disclosure, the vise further comprises a stationary jaw, the moveable jaw clamping the workpiece with the moveable jaw and the stationary jaw in the clamp position.

In further alternative forms of the exemplifications of the disclosure, a jaw opening is defined between the stationary jaw and the moveable jaw, the workpiece positioned in the jaw opening in the clamp position.

In additional forms of the exemplifications of the disclosure, the vise further comprises a second jaw, wherein the moveable jaw is moved away from the second jaw to position the vise from the open position to the clamp position.

In further alternative forms of the exemplifications of the disclosure, the moveable jaw comprises a plurality of moveable jaws.

In another exemplification thereof, the present disclosure provides a method of machining a plurality of workpieces, comprising: placing one of the plurality of workpieces in a vise having a moveable jaw and a fine moveable jaw drive operable to actuate the moveable jaw within a fine moveable jaw drive travel distance; grossly actuating the moveable jaw to a near clamp position spaced a distance less than the fine moveable jaw drive travel distance from a dimension of the one of the plurality of workpieces; locking the moveable jaw to prevent the moveable jaw from moving away from the dimension of the one of the plurality of workpieces to a distance of more than the fine moveable jaw drive travel distance, whereby the locking step positions the moveable jaw so that actuation of the moveable jaw by the fine moveable jaw drive within the fine moveable jaw drive travel distance will position the moveable jaw to clamp the one of the plurality of workpieces along the dimension of the one of the plurality of workpieces; and clamping the workpiece with the moveable jaw by actuating the fine moveable jaw drive to actuate the moveable jaw from the near clamp position to a clamp position where the moveable jaw clamps the workpiece.

In alternatives forms of the exemplary method, the method further comprises: detecting a position of the moveable jaw relative to the workpiece during grossly actuating the moveable jaw; and ceasing grossly actuating the moveable jaw in response to detecting that the moveable jaw has achieved the near clamp position spaced a distance less than the fine moveable jaw drive travel distance from the dimension of the one of the plurality of workpieces. In certain further alternative forms, the detecting step comprises detecting with a proximity sensor. In other alternative forms, the detecting step comprises detecting with a motor sensor.

In alternatives forms of the exemplary method, the method further comprises: inputting the workpiece dimension into a controller controlling the grossly actuating step; calculating with the controller a gross travel distance needed to position the moveable jaw in the near clamp position spaced the distance less than the fine moveable jaw drive travel distance from the dimension of the one of the plurality of workpieces; and wherein the grossly actuating step comprises actuating the moveable jaw over the gross travel distance needed to position the moveable jaw in the near clamp position spaced the distance less than the fine moveable jaw drive travel distance from the dimension of the one of the plurality of workpieces.

In alternatives forms of the exemplary method, clamping comprises clamping the workpiece with the moveable jaw and a stationary jaw. In further alternatives of this form of the disclosure, grossly actuating comprises moving the moveable jaw away from the stationary jaw. In alternatives forms of the exemplary method, the moveable jaw comprises a plurality of moveable jaws and grossly actuating comprises grossly actuating the plurality of moveable jaws.

BRIEF DESCRIPTION OF THE DRAWINGS

The above mentioned and other features and objects of this invention, and the manner of attaining them, will become more apparent and the invention itself will be better understood by reference to the following description of an embodiment of the invention taken in conjunction with the accompanying drawings, wherein.

Corresponding reference characters indicate corresponding parts throughout the several views. The exemplification set out herein illustrates an exemplary embodiment of the invention and such exemplification is not to be construed as limiting the scope of the invention in any manner.

DESCRIPTION OF EMBODIMENTS OF THE PRESENT INVENTION

The embodiments disclosed below are not intended to be exhaustive or limit the invention to the precise forms disclosed in the following detailed description. Rather, the embodiments are chosen and described so that others skilled in the art may utilize their teachings.

The disclosure provides a vise capable of automatically holding a number of workpieces having disparate clamp dimensions during a manufacturing run.

In certain embodiments of the disclosure, a gross moveable jaw drive actuates one or more moveable jaws of the vise by gross increments within a gross moveable jaw stroke, while a fine moveable jaw drive actuates the one or more moveable jaws within a fine moveable jaw stroke. The gross moveable jaw stroke is longer than the fine moveable jaw stroke. With this construction, the gross moveable jaw drive can be utilized to actuate the one or more moveable jaws of the vise over a distance greater than the fine moveable jaw drive stroke to a position in which actuation of the fine moveable jaw drive is capable of positioning the one or more moveable jaws in a clamp position holding the workpiece for machining by the CNC machine. In certain embodiments, the fine moveable jaw drive actuates the one or more moveable jaws within one of the plurality of gross increments.

Figure 1:
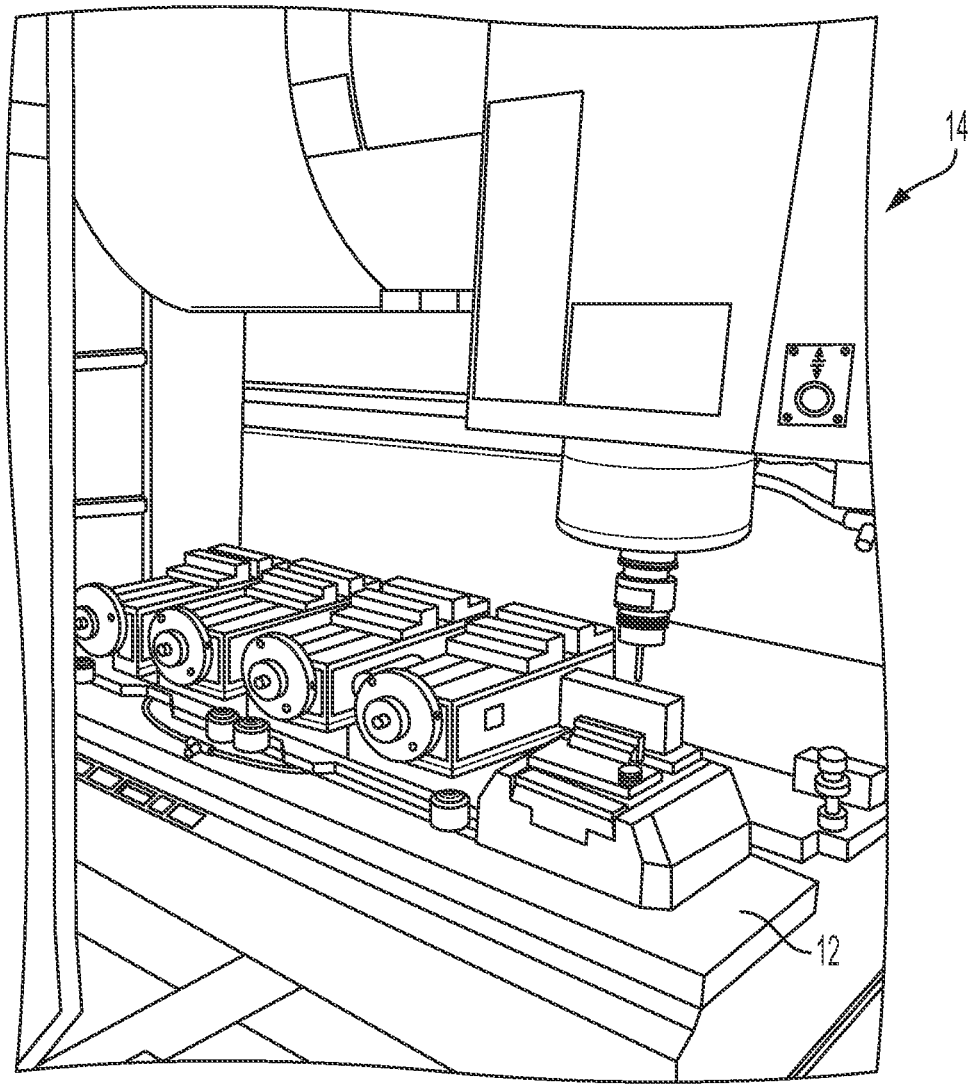
FIG. 1 illustrates a multiple vise setup in a CNC machine.
Figure 2A:
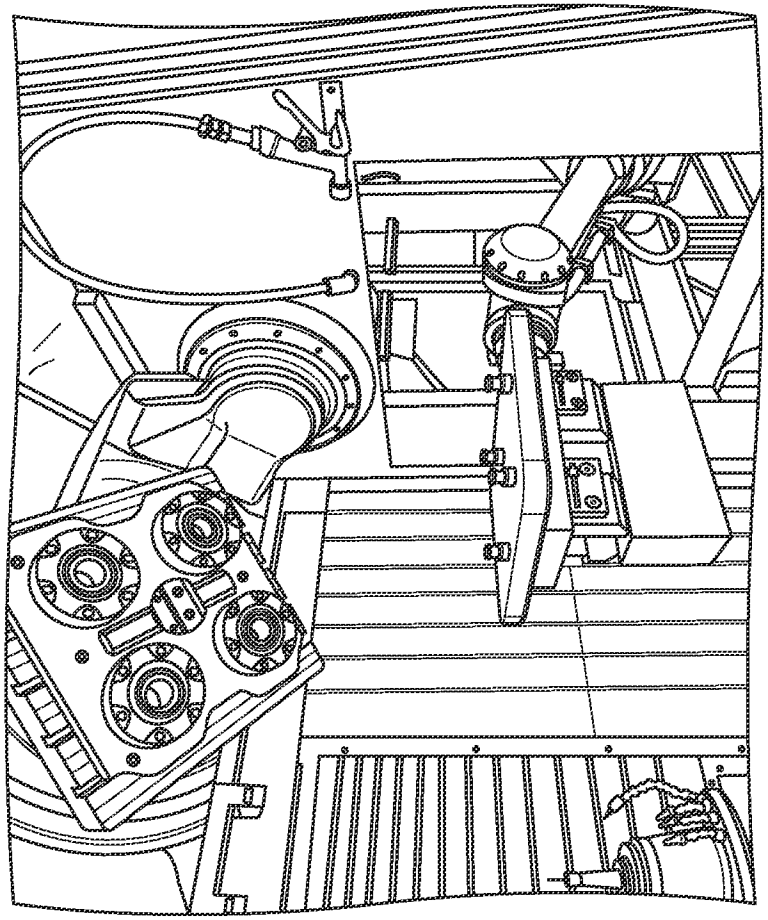
FIGS. 2A-2C illustrate robotic fixture exchange in a CNC machine.
Figure 2B:
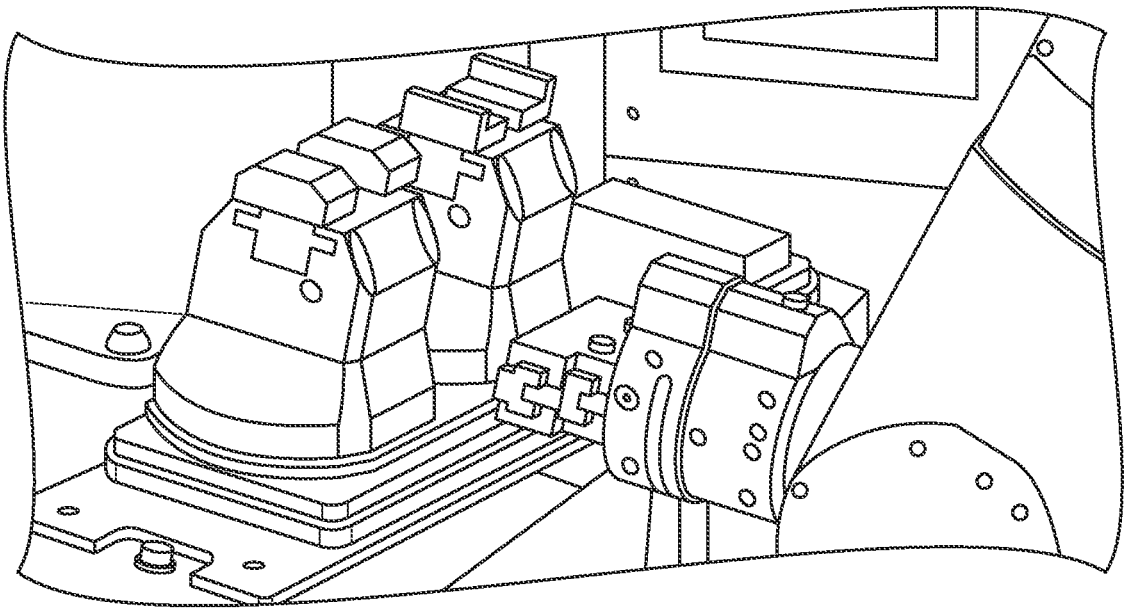
Figure 2C:
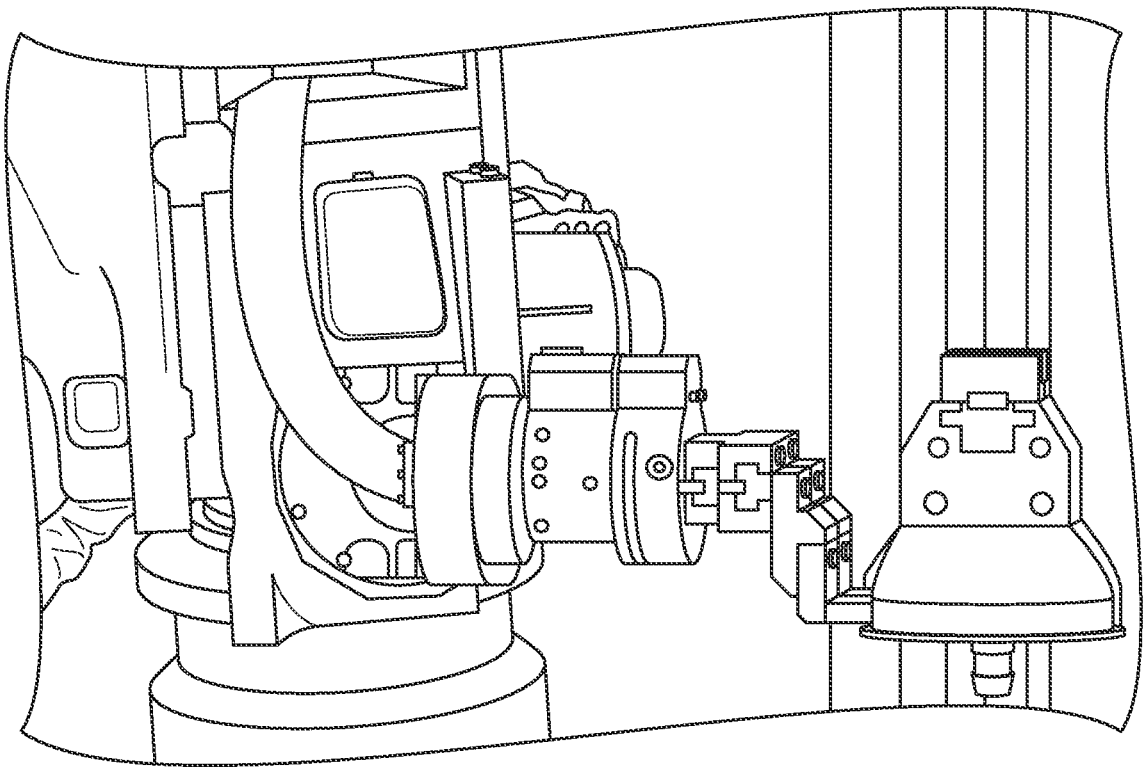
Figure 3:
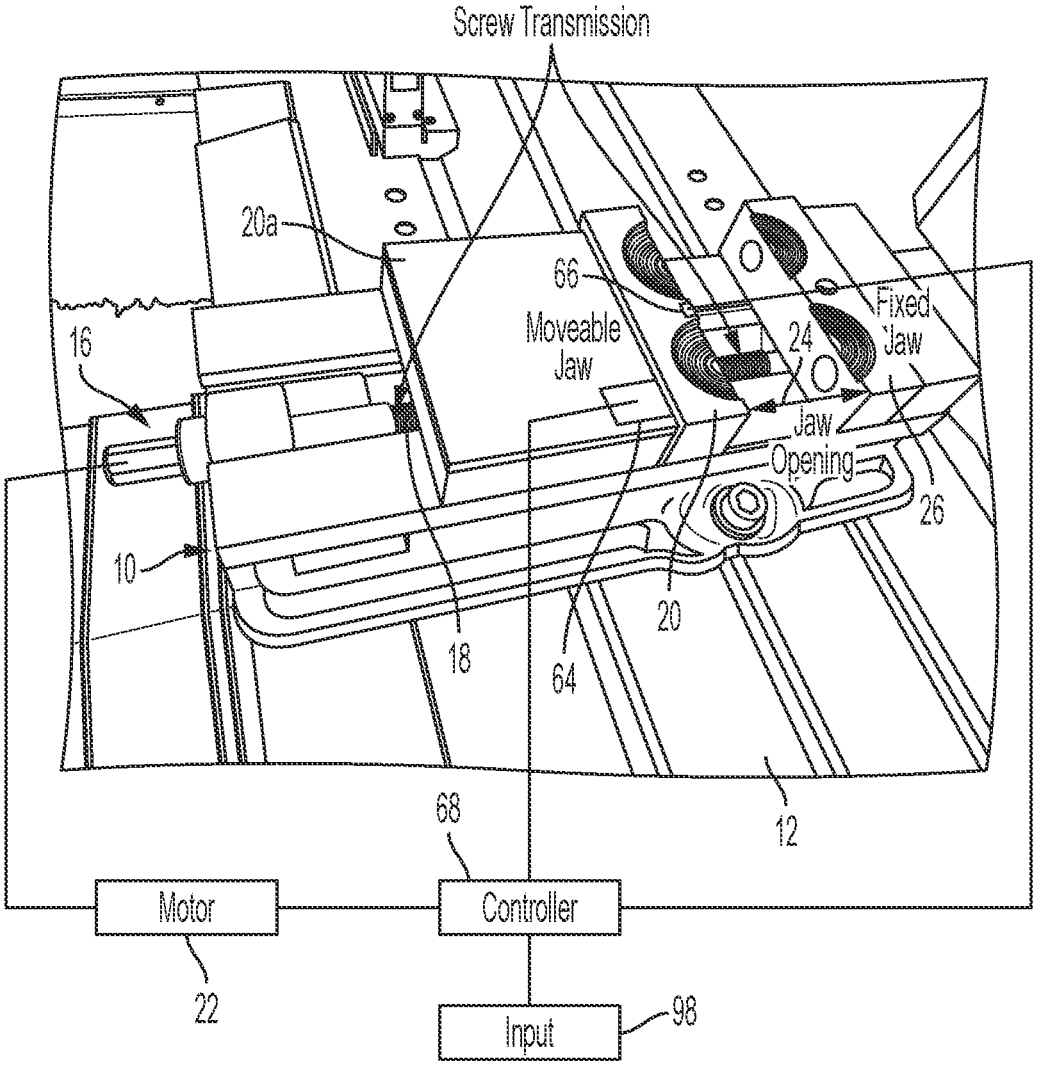
FIG. 3 illustrates an embodiment of a vise in accordance with the present disclosure.

Referring to FIG. 3, vise 10 is secured to table 12 of CNC machine 14 (see FIG. 1). In this position, vise 10 is operable to hold a workpiece for shaping by CNC machine 14. While the vise of the present disclosure is described in connection with CNC machine 14, it is useable with alternative shaping and cutting machines.

As described above, a vise featuring a typical pneumatic or hydraulic clamp would have a limited stroke (typically 6 mm or less). During a manufacturing run, a robot could be used to sequentially position workpieces for shaping by CNC machine 14. In such a process, the following sequential steps would be followed: the vise would be opened to allow the robot to position the workpiece within the jaws of the vise, the vise would be closed to clamp the workpiece in position during the forming operation of the CNC machine, the vise would be opened to allow removal of the shaped workpiece by a robot and the process would repeat. As mentioned above, such a vise would not be able to automatically accommodate different workpieces that could not be accommodated by the limited stroke of the vise.

Vise 10 alleviates this shortcoming by incorporating both a gross moveable jaw drive and a fine moveable jaw drive. Referring to FIG. 3, gross moveable jaw drive 16 utilizes a screw drive including drive screw 18 threadedly engaged with moveable jaw carriage 20*a*. Moveable jaw carriage 20*a* carries moveable jaw 20, with moveable jaw 20 actuatable relative to moveable jaw carriage 20*a* via a fine moveable jaw drive, as will be further described hereinbelow. Drive screw 18 can be rotated by motor 22 to actuate moveable jaw carriage 20*a* and moveable jaw 20 therewith between an open position in which moveable jaw 20 creates the largest jaw opening 24 allowed by vise 10.

Jaw opening 24 is defined by the distance between moveable jaw 20 and fixed jaw 26 along the direction of travel of moveable jaw 20, which, in this embodiment, will be parallel to the longitudinal axis of drive screw 18. To effect gross translation of moveable jaw 20, drive screw 18 is rotatable relative to moveable jaw carriage 20*a* and threadably engaged therewith. Moveable jaw carriage 20*a* is prevented from rotating with drive screw 18; therefore, as drive screw 18 is rotated by motor 22, the threaded engagement of moveable jaw carriage 20*a* with drive screw 18 translates the rotation of drive screw 18 into linear translation of moveable jaw carriage 20*a* (and moveable jaw 20 therewith) along the longitudinal axis of drive screw 18.

Figure 4A:
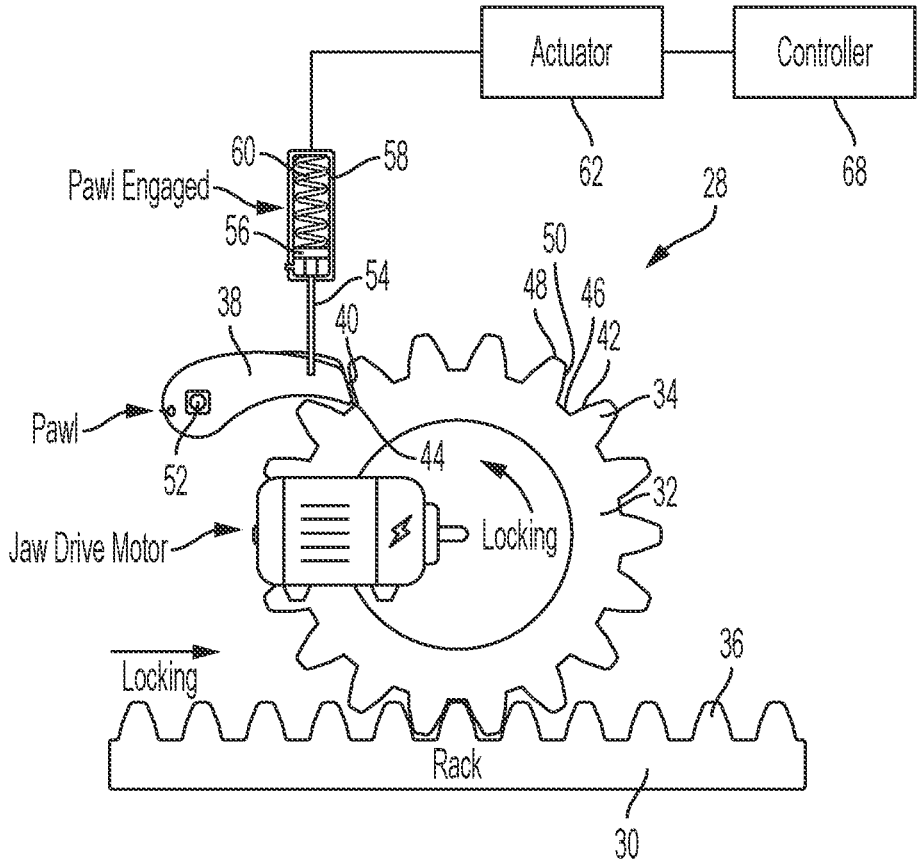
FIGS. 4A and 4B illustrate an embodiment of a lock in accordance with an embodiment of the present disclosure in the lock and unlock positions, respectively.
Figure 4B:
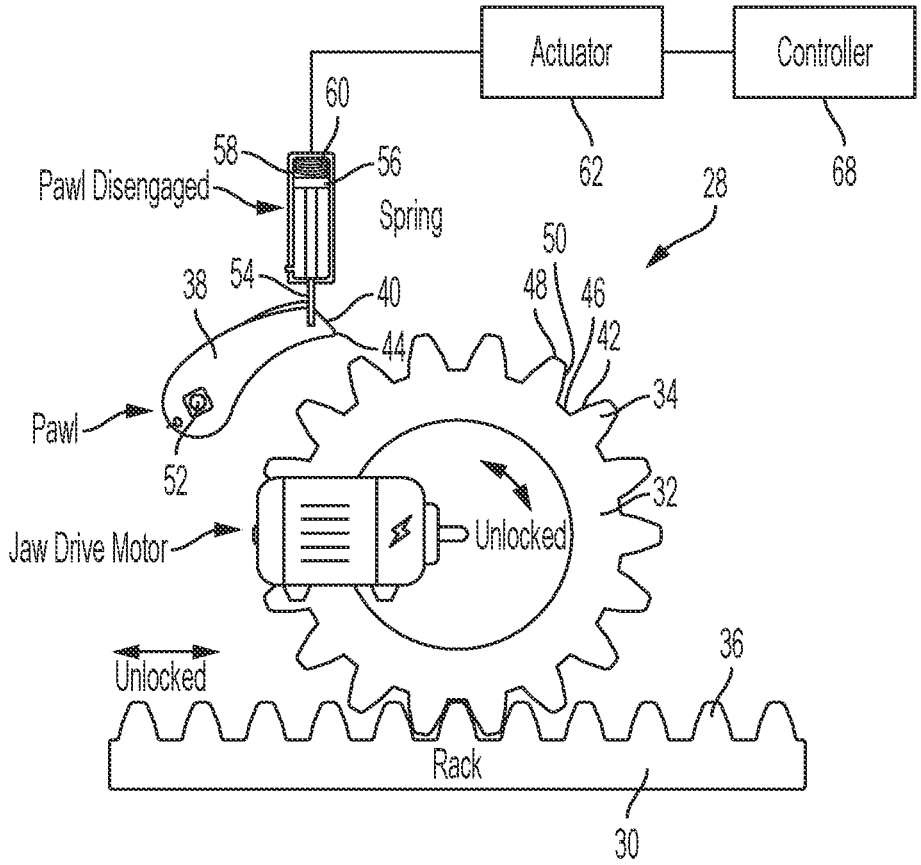

Gross moveable jaw drive 16 is able to translate moveable jaw 20 by gross increments. FIGS. 4A and 4B illustrate lock 28 which can be utilized to define such gross increments. Lock 28 includes rack 30 and gear 32. Rack 30 is secured for linear translation with moveable jaw carriage 20*a* and gear 32 is rotatably supported by the chassis of vise 10. Alternatively, motor 22, pawl 38, and rack 30 could be mounted on the vise frame, thereby making the vise more compact throughout its range of motion. Gear teeth 34 (only one of which is numbered in FIGS. 4A and 4B for simplicity) of gear 32 are in meshed engagement with rack teeth 36 (only one of which is numbered in FIGS. 4A and 4B for simplicity) of rack 30 so that translation of moveable jaw carriage 20*a* (and; therefore, translation of rack 30 secured thereto) causes rotation of gear 32. Rotation of gear 32 and; therefore, translation of rack 30 and moveable jaw 20 can be restricted by pawl 38. Rack 30 and gear 32 may, alternatively, comprise the gross moveable jaw drive, with gear 32 being driven by a jaw drive motor to actuate moveable jaw carriage 20*a*. A belt drive may also be alternatively implemented as the gross moveable jaw drive mechanism.

Pawl 38 includes stop flank 40 engageable with a stop flank 42 (only one of which is numbered in FIGS. 4A and 4B for simplicity) of a tooth 34 of gear 32 to unidirectionally prevent rotation of gear 32 and; therefore, translation of rack 30 and moveable jaw carriage 20*a*. More particularly, with pawl 38 engaged with gear teeth 34 of gear 32 (as illustrated in FIG. 4A), rotation of gear 32 in the direction of the rotational "Locking" arrow shown in FIG. 4A is prevented as stop flank 40 of pawl 38 abuts stop flank 42 of a tooth 34 of gear 32. Locking gear 32 against rotation in the direction of the rotational "Locking" arrow of FIG. 4A will prevent translation of moveable jaw 20 to a more open position (i.e., a position in which jaw opening 24 is larger) along the linear "Locking" arrow shown in FIG. 4A. Stated another way, the linear "Locking" arrow of FIG. 4A points to a direction of movement of moveable jaw 20 away from fixed jaw 26.

With pawl 38 positioned as shown in FIG. 4A, translation of moveable jaw 20 toward fixed jaw 26 is allowed. Particularly, translation of moveable jaw carriage 20*a* toward fixed jaw 26 thereby translates rack 30 in a linear direction opposite to the linear "Locking" arrow shown in FIG. 4A. This translation of rack 30 will cause tip 44 of pawl 38 to travel along bottom land 46 (only one of which is numbered in FIGS. 4A and 4B for simplicity) separating adjacent teeth 34 of gear 32, over actuation flank 50 (only one of which is numbered in FIGS. 5A and 5B for simplicity) of a tooth 34 of gear 32, and over top land 48 (only one of which is numbered in FIGS. 4A and 4B for simplicity) until stop flank 40 of pawl 38 rests against the stop flank 42 of the next tooth 34 of gear 32. During this movement, pawl 38 rotates about the longitudinal axis of pawl pin 52, which rotatably supports pawl 38 on the chassis of vise 10. The travel of moveable jaw 20 associated with the movement of stop flank 40 of pawl 38 from one stop flank 42 to the next adjacent stop flank 42 is a "gross increment" of movement of moveable jaw 20. Pawl 38 may also be moved to the position illustrated in FIG. 4B to allow for closing (i.e., decreasing jaw opening 24) vise 10 without the ratcheting described above or for opening of vise 10.

Gross moveable jaw drive 16 is operable to actuate moveable jaw 20 through a plurality of gross increments. For example, with moveable jaw 20 in a fully open position of vise 10, i.e., with jaw opening 24 maximized, and pawl 38 positioned as shown in FIG. 4A, gross moveable jaw drive 16 can be actuated to move moveable jaw 20 toward fixed jaw 26. With this movement of moveable jaw 20 comes movement of rack 30 in a direction opposite to the linear "Locking" arrow shown in FIG. 4A, which causes pawl 38 to progress from one stop flank 42 to the next stop flank 42 on gear 32, as described in more detail above.

Pawl actuation rod 54 is rotatably connected to pawl 38 at one end and fixedly secured to piston 56 at the other. Piston 56 is configured to reciprocate within cylinder 58 against the spring force of compression spring 60. Spring 60 works to bias piston 56 to the position shown in FIG. 4A and thereby biases tip 44 of pawl 38 toward gear 32 to effect the ratcheting movement described above in directions of gear 32 and rack 30 opposite the Locking directions depicted in FIG. 4A, which correspond to movement of moveable jaw 20 toward fixed jaw 26 to decrease the size of jaw opening 24. Cylinder 58 may be rotatably supported at its end opposite pawl 38 to facilitate this functionality.

While lock 28 allows moveable jaw carriage 20*a* to carry moveable jaw 20 from a position having a relatively larger jaw opening 24 to a position having a relatively smaller jaw opening 24 with pawl 38 positioned as shown in FIG. 4A, movement in the opposite direction is prevented, as described in detail above. To open vise 10 by gross increments, pawl 38 must be actuated from the position shown in FIG. 4A to the position shown in FIG. 4B. Actuator 62 is operable to cause such actuation. Actuator 62 can take a number of forms. For example, Actuator 62 can be an electromagnet energizeable to create a magnetic force to pull a ferrous piston 56 from the position shown in FIG. 4A to the position shown in FIG. 4B. Actuator 62 can also be a motor drive connected to cylinder 58 and operable to actuate cylinder 58 away from gear 32 to disengage tip 44 of pawl 38 from gear teeth 34.

Figure 5A:
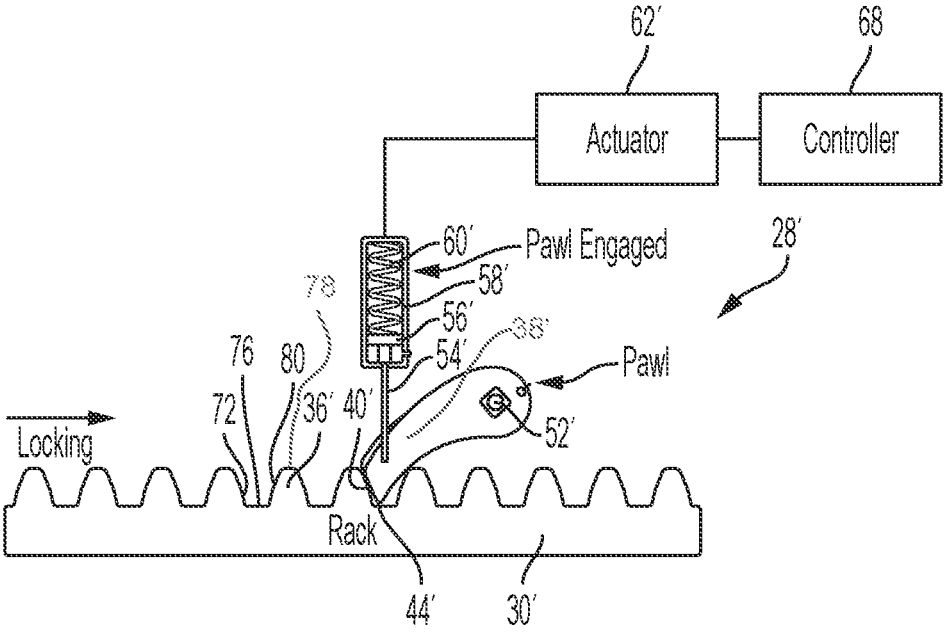
FIGS. 5A and 5B illustrate an embodiment of a lock in accordance with another embodiment of the present disclosure in the lock and unlock positions, respectively.
Figure 5B:
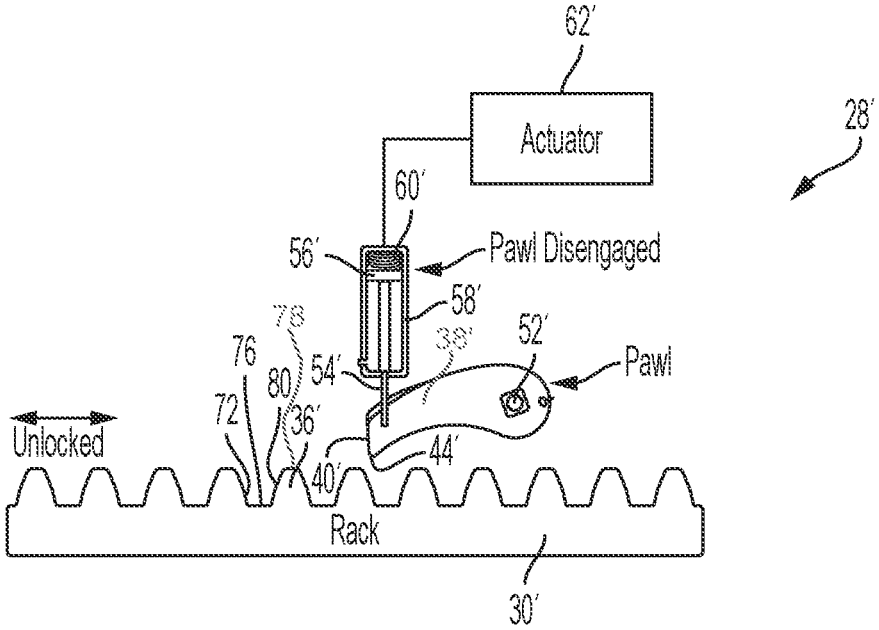

FIGS. 5A and 5B illustrate an alternative embodiment lock 28'. In short, lock 28' eliminates gear 32 and positions pawl 38' to directly interact with rack 30'. Otherwise, lock 28' functions as described above with respect to lock 28. Rack 30' is secured for linear translation with moveable jaw carriage 20*a* and pawl 38' is rotatably supported on the chassis of vise 10 by pawl pin 52'.

Pawl 38' includes stop flank 40' engageable with a stop flank 72 (only one of which is numbered in FIGS. 5A and 5B for simplicity) of a tooth of rack 30' to unidirectionally prevent translation of rack 30' and moveable jaw carriage 20*a* (to which rack 30' is secured). More particularly, with pawl 38' engaged with rack teeth 36' of rack 30' (as illustrated in FIG. 5A), translation of rack 30' in the direction of the "Locking" arrow shown in FIG. 5A is prevented as stop flank 40' of pawl 38' abuts stop flank 72 of a tooth of 36' of rack 30'. Locking rack 30' against translation in the direction of the "Locking" arrow of FIG. 5A will prevent translation of moveable jaw 20 to a more open position (i.e., a position in which jaw opening 24 is larger). Stated another way, the linear "Locking" arrow of FIG. 5A points to a direction of movement of moveable jaw 20 away from fixed jaw 26.

With pawl 38' positioned as shown in FIG. 5A, translation of moveable jaw 20 toward fixed jaw 26 is allowed. Particularly, translation of moveable jaw 20 toward fixed jaw 26 thereby translates rack 30' in a linear direction opposite to the linear "Locking" arrow shown in FIG. 5A. This translation of rack 30' will cause tip 44' of pawl 38' to travel along bottom land 76 (only one of which is numbered in FIGS. 5A and 5B for simplicity) separating adjacent teeth 36' of rack 30', over actuation flank 80 (only one of which is numbered in FIGS. 5A and 5B for simplicity) of a tooth 36' of rack 30', and over top land 78 (only one of which is numbered in FIGS. 5A and 5B for simplicity) until stop flank 40' of pawl 38' rests against the stop flank 72 of the next tooth 36' of rack 30'. During this movement, pawl 38' rotates about the longitudinal axis of pawl pin 52', which rotatably supports pawl 38' on the chassis of vise 10. The travel of moveable jaw 20 associated with the movement of stop flank 40' of pawl 38' from one stop flank 72 to the next adjacent stop flank 72 is a "gross increment" of movement of moveable jaw 20.

Gross moveable jaw drive 16 (FIG. 3) is operable to actuate moveable jaw 20 (carried by moveable jaw carriage 20*a*) through a plurality of gross increments. For example, with moveable jaw 20 in a fully open position of vise 10, i.e., with jaw opening 24 maximized, and pawl 38' positioned as shown in FIG. 5A, gross moveable jaw drive 16 can be actuated to move moveable jaw 20 toward fixed jaw 26. With this movement of moveable jaw 20 comes movement of rack 30' in a direction opposite to the "Locking" arrow shown in FIG. 5A, which causes pawl 38' to progress from one stop flank 72 to the next stop flank 72 on rack 30', as described in more detail above. Pawl 38' may also be moved to the position illustrated in FIG. 5B to allow for closing (i.e., decreasing jaw opening 24) vise 10 without the ratcheting described above or for opening of vise 10.

Pawl actuation rod 54', piston 56', cylinder 58', spring 60', and actuator 62' operate in the same fashion as described with respect to the corresponding elements of the embodiment illustrated in FIGS. 4A and 4B; therefore, a detailed description of these elements is here omitted for the sake of brevity.

Fine moveable jaw drive 64 is interposed between and connects moveable jaw carriage 20*a* and moveable jaw 20. Fine moveable jaw drive 64 comprises one of the pneumatic or hydraulic vise mechanisms well known in the art. For the sake of brevity, a detailed description of these well know devices is not provided here. With moveable jaw 20 positioned by gross moveable jaw drive 16, fine moveable jaw drive 64 can, in certain embodiments, be used to actuate moveable jaw 20 within a gross increment defined by lock 28 or lock 28'.

In an exemplary vise 10 of the present disclosure, gross moveable jaw drive 16 will cooperate with lock 28 to create a gross increment of 6 mm. In this exemplification, fine moveable jaw drive 64 will have a stroke of 6 mm. In an exemplary manufacturing run in which CNC machine 14 is used to shape first workpieces having a clamp dimension (as that term is defined above) of 20 mm, gross moveable jaw drive 16 will actuate moveable jaw 20 to a near clamp position (i.e., a clamp position in which moveable jaw 20 is not further than the fine moveable jaw drive stroke from the workpiece, with the workpiece positioned against fixed jaw 26). For example, the gross moveable jaw drive 16 would actuate moveable jaw 20 to create a jaw opening 24 of 24 mm. from this position, fine moveable jaw drive 64 could be actuated to a clamp position holding the workpiece firm and fast for machining. In the same manufacturing run second workpieces having a clamp dimension of 10 mm could be shaped by CNC machine 14. When transitioning from a first workpiece to a second workpiece in this example, gross moveable jaw drive 16 would actuate moveable jaw 20 from a position creating a jaw opening 24 of 24 mm to a position creating a jaw opening 24 of 12 mm.

Figure 10:
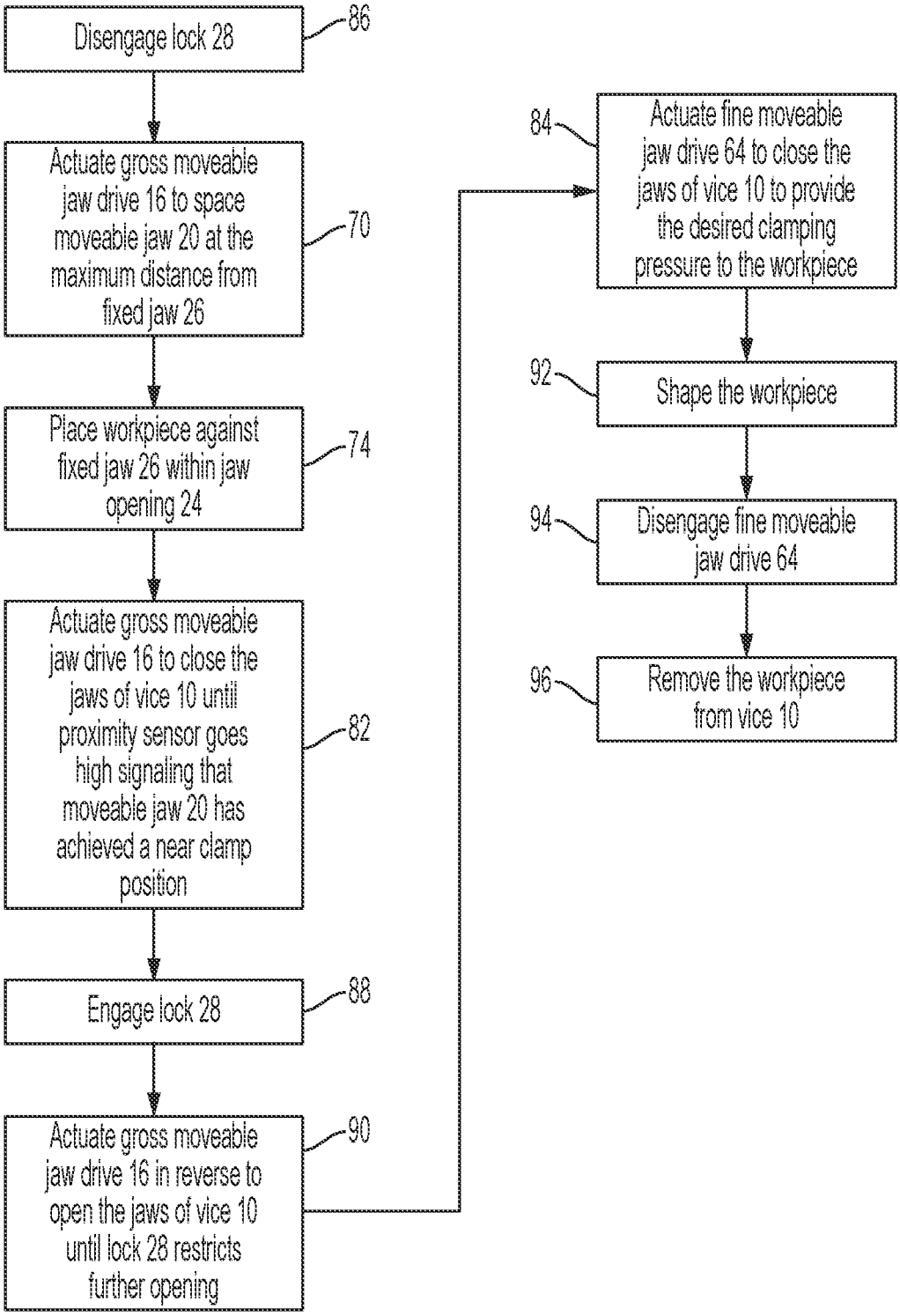
FIG. 10 illustrates an exemplary manufacturing process in accordance with the present disclosure.

In a first exemplification of the present disclosure, proximity sensor 66 is embedded in moveable jaw 20 and is operable to detect the proximity of moveable jaw 20 to a workpiece positioned in jaw opening 24. Proximity sensor 66 is communicatively connected to controller 68, which controls actuation of gross moveable jaw drive 16. An exemplary manufacturing process implementing proximity sensor 66 is illustrated in FIG. 10. The process begins at step 86 with controller 68 signaling actuator 62 to disengage lock 28. Step 86 is effected by moving pawl 38 upwardly out of engagement with gear teeth 34 in the embodiment illustrated in FIGS. 4A and 4B or by moving pawl 38' upwardly out of engagement with rack teeth 36 in the embodiment illustrated in FIGS. 5A and 5B. In step 70, controller 68 actuates gross moveable jaw drive 16 (fine moveable jaw drive 64 will already be fully opened) to space moveable jaw 20 the maximum distance from fixed jaw 26 to create the largest jaw opening 24 allowed by vise 10. In step 74 a workpiece is placed against fixed jaw 26 within jaw opening 24. Step 74 will, in an automated process, be performed by a robot receiving control from controller 68. In step 82, controller 68 actuates gross moveable drive 16 to move moveable jaw 20 toward fixed jaw 26 until proximity sensor 66 provides a signal indicating that moveable jaw 20 is a specified distance from the workpiece (e.g., 2 mm). During step 82, in certain exemplary embodiments, the robot will remain holding the workpiece against fixed jaw 26. In this exemplification, the gross increment can be chosen to be 2 mm less than the stroke of fine moveable jaw drive 64. At step 88, controller 68 signals actuator 62 to engage lock 28 by positioning pawl 38 in engagement with gear teeth 34 in the embodiment illustrated in FIGS. 4A and 4B or by positioning pawl 38' in engagement with rack teeth 36 in the embodiment illustrated in FIGS. 5A and 5B. Step 88 may precede step 74 or step 82 in an alternative embodiment. In such an embodiment, lock 28, 28' would ratchet during step 82. At step 90, gross moveable jaw drive 16 is actuated in reverse until pawl 38 or 38' abuts stop flank 40 or 42, respectively, depending on which lock 28 or 28' is implemented. Step 90 may comprise no reverse movement (in the case that step 82 results in pawl 38 or 38' abutting stop flank 40 or 42) to movement of just less than the gross increment. At this point, the work of gross moveable jaw drive 16 is done with respect to the positioned workpiece.

At step 84, controller 68 actuates fine moveable jaw drive 64 to supply the desired clamping pressure to the workpiece during the forming process. Lock 28 or 28' creates a backstop for the pressure exerted by fine moveable jaw drive 64 at step 84. The workpiece is shaped by CNC machine 14 at step 92. At step 94, fine moveable jaw drive 64 is disengaged (i.e., no longer supplies clamping to the workpiece) and finally, at step 96, the workpiece is removed from vise 10. A robot receiving input from controller 68 may be utilized to effect step 96. At this point in the manufacturing run, the method returns to step 86 and the steps illustrated in FIG. 10 and further described above are repeated. Alternatively, when multiple workpieces of the same size are to be processed by CNC machine 14, steps 86, 70, 82, 88 and 90 may be skipped.

Figure 11:
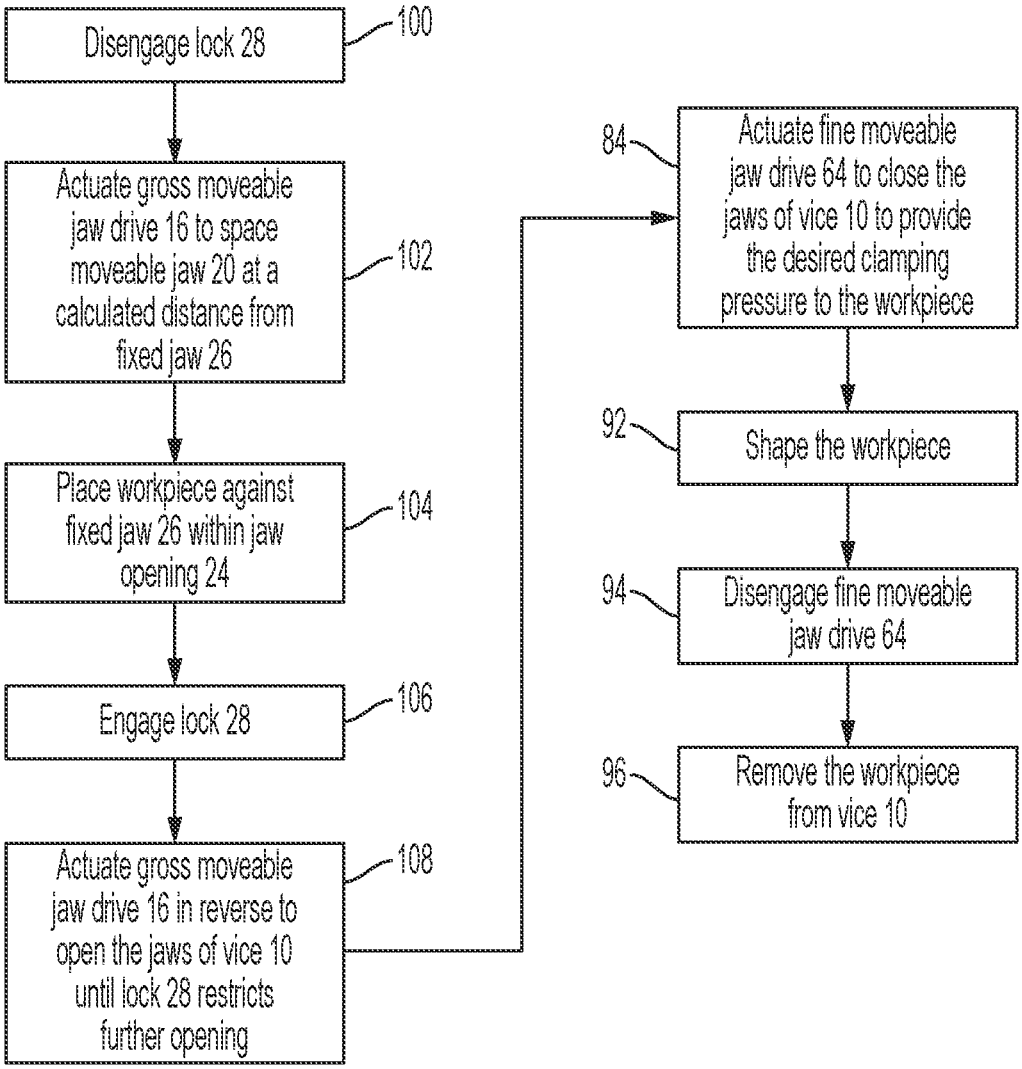
FIG. 11 illustrates another exemplary manufacturing process in accordance with the present disclosure.

In a second exemplification of the present disclosure, proximity sensor 66 is abandoned in favor of input 98. Input 98 can be utilized to input the clamp dimension of the part to be shaped in CNC machine 14. An exemplary manufacturing process implementing input 98 is illustrated in FIG. 11. The process begins at step 100 with controller 68 signaling actuator 62 to disengage lock 28. Step 86 is effected by moving pawl 38 upwardly out of engagement with gear teeth 34 in the embodiment illustrated in FIGS. 4A and 4B or by moving pawl 38' upwardly out of engagement with rack teeth 36 in the embodiment illustrated in FIGS. 5A and 5B. At step 102, controller 68 positions moveable jaw 20 a distance from the workpiece such that even after reversing gross moveable jaw drive 16 to engage lock 28 or 28' to prevent further opening of vise 10 (as described in detail above), that the stroke of fine moveable jaw drive 64 will be sufficient to clamp the workpiece during the forming operation. In step 104, the workpiece is placed against fixed jaw 26 within jaw opening 24. Step 104 will, in an automated process, be performed by a robot receiving control from controller 68. At step 106, controller 68 signals actuator 62 to engage lock 28 or 28' by positioning pawl 38 in engagement with gear teeth 34 in the embodiment illustrated in FIGS. 4A and 4B or by positioning pawl 38' in engagement with rack teeth 36 in the embodiment illustrated in FIGS. 5A and 5B. At step 108, gross moveable jaw drive 16 is actuated in reverse until pawl 38 or 38' abuts stop flank 40 or 42, respectively, depending on which lock 28 or 28' is implemented. At this point, the work of gross moveable jaw drive 16 is done with respect to the positioned workpiece. Steps 84, 92, 94 and 96 described above with respect to the embodiment of FIG. 10 are now implemented to complete forming of the workpiece and the process repeats by returning to step 100 after completing step 96. Input 98 can be utilized to enter differing workpiece sizes during the process. When multiple workpieces of the same size are to be processed by CNC machine 14, steps 100, 102, 106, and 108 may be skipped. In this embodiment, an encoder will be operably associated with motor 22 and communicatively connected to controller 68 so that controller 68 knows the position of the moveable jaw. The input for the part dimension can come from an external application, for example, a robot job manager software a CNC part program, or through a user-interface in the vise controller. A further advantage of this option is that it does not implement the step of the robot picking up the workpiece and holding it in the vise prior to clamping as in the system depicted in FIG. 10.

A third exemplification of the present disclosure incorporates part detection with a motor sensor, e.g., a motor load sensor for monitoring the load on the motor, or a motor sensor configured to detect when the motor or motor drive stops while being commanded to move. This exemplification will follow the steps of FIG. 10 described in detail above, except that step 82 will be replaced by a step 82'. Step 82' comprises: Actuate gross moveable jaw drive 16 to close the jaws of vice 10 until the motor sensor goes high signaling that moveable jaw 20 has contacted the workpiece. Step 82 is replaceable by step 82' in any of the alternatives of the methods of FIGS. 10 and 11 described herein.

Locks 28, 28' described to this point in this document provide for limited movement of moveable jaw 20*a* toward and away from fixed jaw 26. Specifically, locks 28, 28' allow for ratcheting movement of moveable jaw 20*a* toward fixed jaw 26 and also allow movement of moveable jaw away from fixed jaw within a gross increment, as detailed above. In alternative forms of the automatic clamping system of the present disclosure, a fixed lock may be implemented. A fixed lock will lock gross moveable jaw drive 16 such that no movement of moveable jaw 20 along drive screw 18 will be allowed.

A fixed lock may take the form of a spline or Hirth joint, or other torque coupling preventing movement of moveable jaw 20 along drive screw 18 by, e.g., resisting rotational movement of drive screw 18. In the case of a spline or Hirth joint, one of two rotationally locking elements will be carried by drive screw 18 and rotatable therewith, with the other of two rotationally locking elements moveable into and out of engagement therewith while being non-rotatable. In this type of a locking arrangement, the two rotationally locking elements can be disengaged to allow actuation of gross moveable jaw drive 16 to actuate moveable jaw 20 toward or away from fixed jaw 26 and can be engaged to prevent movement of moveable jaw 20 along drive screw 18.

If a lock incorporated in the automatic clamping system of the present disclosure comprises a fixed lock in the form of a spline or Hirth joint, and is utilized in accordance with the method of FIG. 10, then step 90 will be utilized to ensure intermeshing of the teeth/splines of the two components of the spline or Hirth joint. Similarly, if a fixed lock in the form of a spline or Hirth joint is utilized in accordance with the method of FIG. 11, then step 108 will be utilized to ensure intermeshing of the teeth/splines of the two components of the spline or Hirth joint. Steps 88 and 106 of the methods of FIGS. 10 and 11, respectively, will engage the fixed lock by moving and biasing the component not rotationally secured to drive screw 18 toward intermeshing engagement with the component rotationally secured to drive screw 18. If this movement leads to engagement of the top lands of the teeth of the opposing joint components, then steps 90, 108 of the methods of FIGS. 10 and 11 will cooperate with the biasing (e.g., by spring force) of steps 88 and 106 to place the coupling components in intermeshing and rotationally locked engagement. In such an instance, the "gross increment" should be taken as the travel from the engagement of the top lands of the teeth of the opposing joint components to the intermeshing and rotationally locked engagement of the opposing joint components.

Gross moveable jaw drive 16 may itself comprise a fixed lock. Locks 28, 28', and the fixed locks described above should be considered to form a part of gross moveable jaw drive 16; however, in certain embodiments, the gross moveable jaw drive 16 will be designed such that the clamping force of fine moveable jaw drive 64 is not capable of back-driving gross moveable jaw drive 16. In these circumstances, no additional components (beyond those necessary to actuate moveable jaw 20 as described above) are needed to form a lock useable in the automatic clamping system of the present disclosure. More particularly, a highly inefficient drive screw 18 can act as a fixed lock.

The properties of a highly inefficient screw system can be leveraged to provide the necessary locking characteristics for gross moveable jaw drive 16, albeit with a near-infinite locking number of locking positions. Gross moveable jaw drive 16 itself will not be strong enough to provide the sole clamping force to the workpiece, so the fine moveable jaw drive will remain necessary for the vise application to provide the clamping force to hold the workpiece. Highly inefficient screws can eliminate the possibility of gross moveable drive 16 to be back-driven and opened when an axial force is applied to the jaw connected to the fine moveable jaw drive if the inefficiency of the transmission system (the lead screw, i.e., drive screw 18) of gross moveable jaw drive 16, which based on the amount of friction in the assembly, is greater than the back driving torque (force applied to the clamping jaw of the fine moveable jaw). If the friction is high enough, gross moveable jaw drive 16 can effectively be locked and hold its position when clamping a part with fine moveable jaw drive 64.

The efficiency of a lead screw (such as drive screw 18) is determined by how well a screw converts rotational energy (torque) into linear motion. Equation #1 can be used to compute a screw's efficiency. Using Equation #2 below, the back-driving torque can be compared to the friction of the screw transmission of gross moveable jaw drive 16 to ensure that the design cannot be back-driven and will thus hold the clamping pressures resulting from fine moveable jaw drive 64.

$$\% E = \frac{\tan(\phi)}{\tan(\phi + a\tan(f))} \times 100$$

Where:
% E=efficiency of a lead screw
ø=helix angle of the screw thread
f=coefficient of friction $$T_b = \frac{(F \cdot P \cdot \% E)}{2\pi}$$

Where:
$T_b$=back driving torque (Nm)
F=axial load on the clamping jaw (N)
P=screw lead (m)
% E=efficiency of the screw (0.2-0.5 typical for lead screws)

The automatic clamping system of the present disclosure incorporates a control unit (e.g., controller 68 and an associated display) that indicates when vise 10 is clamped, unclamped, and when in process of finding the part when readjusting to the part dimensions (e.g., in the embodiment illustrated in FIG. 10). The control unit can be located outside the CNC machine system and can connect to a job manager that controls and orchestrates the sequencing of jobs between the robot, CNC machine, and vise 10 based on the determined production schedule of parts.

Figure 6:
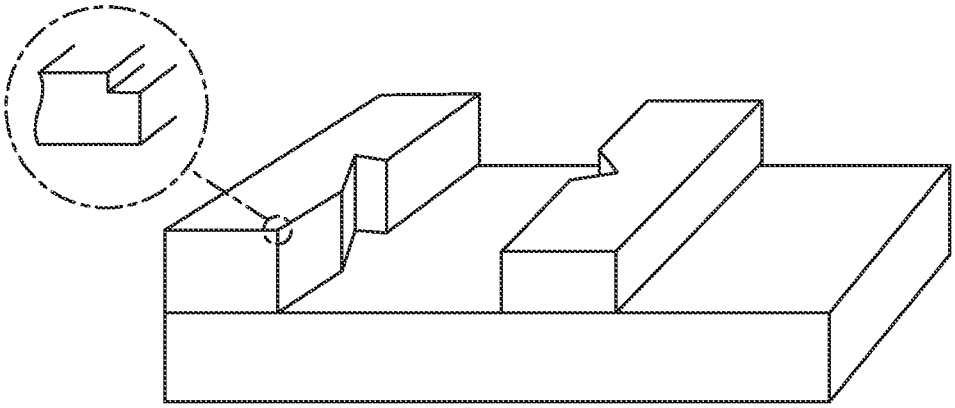
FIG. 6 illustrates alternative jaw geometries useable with a vise of the present disclosure.

To handle a high mix of parts of different geometry types, the jaws can have a V-groove in their centers to allow clamping onto cylindrical parts. Also, to hold rectangular and flat-edged parts, a small lip will be machined into the jaws that will allow the robot to hold the workpiece against the jaws. Examples of these geometries are shown in FIG. 6. Custom part geometries may also be machined into the jaws if needed.

Figure 7:
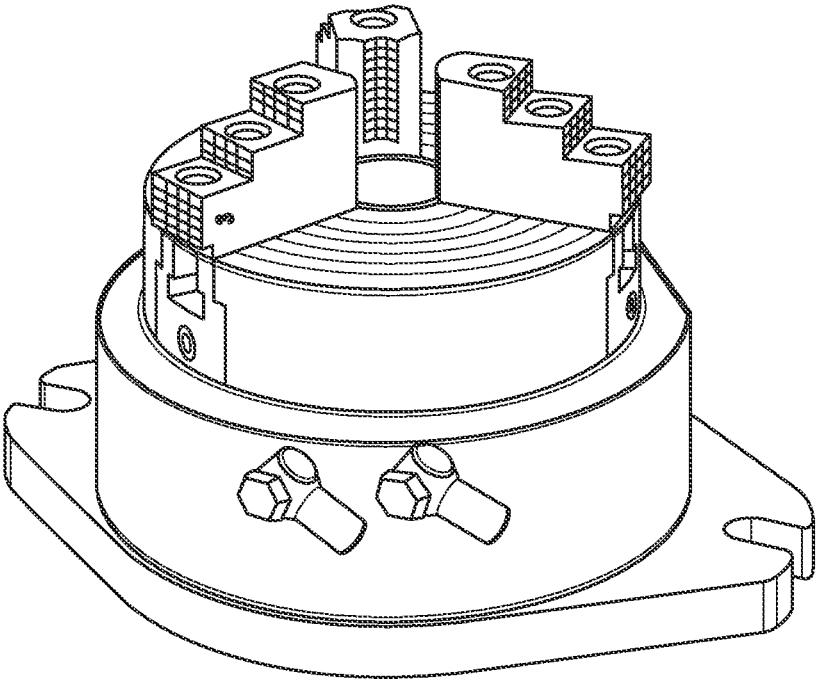
FIG. 7 illustrates a 3-*jaw* automated chuck for cylindrical parts useable with the teachings of the present disclosure.

In variations of the present disclosure, the vise may incorporate more than one moveable jaw. For example, fixed jaw 26 described above may comprise a moveable jaw articulatable in the same way as described above with respect to moveable jaw 20. Furthermore, the present disclosure can be implemented in a 3-*jaw* automated chuck for purely cylindrical parts (see FIG. 7) whereby, each of the jaws will be coordinated to move based on either individually coordinated drive and transmission mechanisms or the 3 jaws will be mechanically linked (for example a drill chuck mechanism) with a single motor drive system. Importantly, the "closing" direction of the vise can be defined by the jaws being drawn closer as in the exemplifications depicted in FIGS. 1-9 and described above, or by the jaws being further separated, as could be the case of the jaw chuck shown in FIG. 7.

Figure 8:
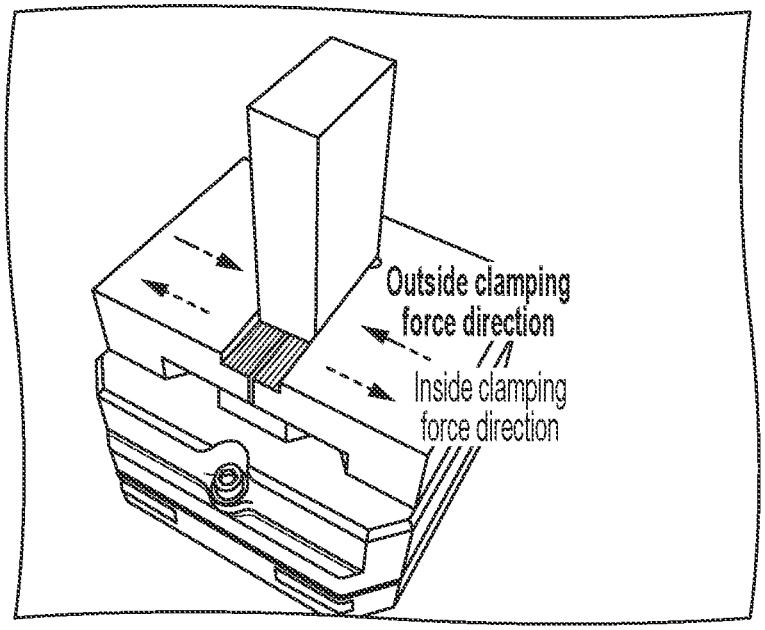
FIG. 8 illustrates a vise useable with the teachings of the present disclosure in both inward and outward clamping functions.
Figure 9:
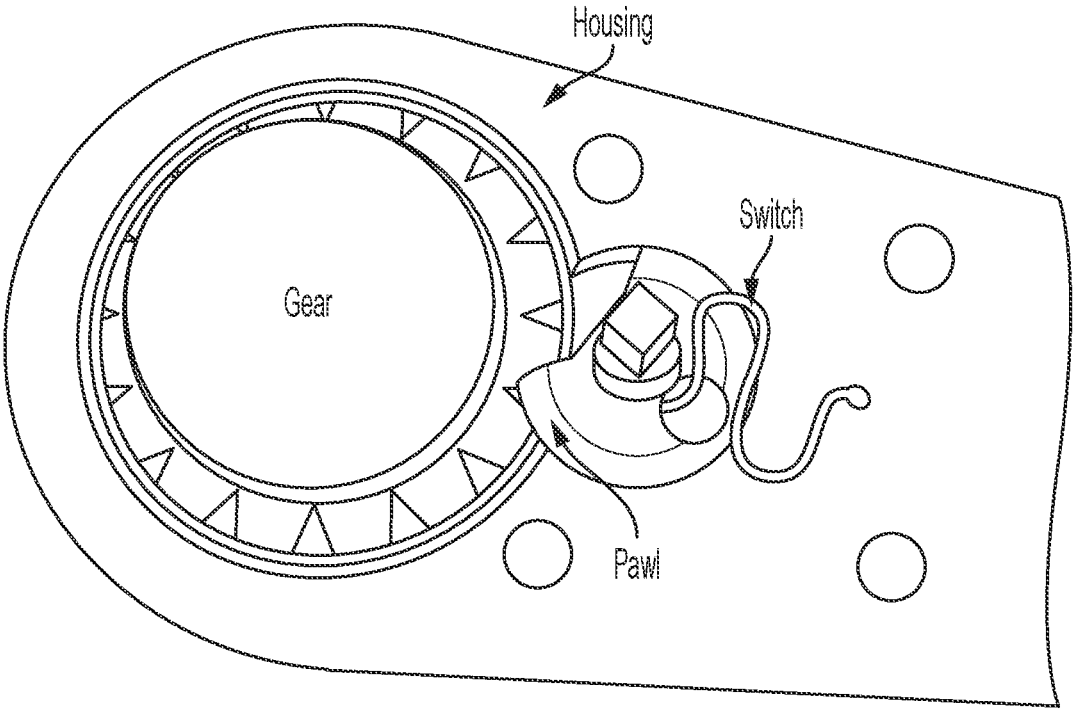
FIG. 9 illustrates a bidirectional ratchet mechanism implementable with outward and inward clamping vises in accordance with teachings of the present disclosure.

The automatic vise systems of the present disclosure can also be applied for both outside and inside clamping or ID (inner diameter) or OD (outer diameter) clamping of cylindrical stock by using a similar ratchet locking system mechanism used in ratchet drivers (see FIG. 9). The clamping pressure mechanism will of course need to support outer and inner directional clamping. There are several options available today including a simple 45-degree slide that applies the same pressure but in either direction based on whether the vise is commanded to open or close (FIG. 8). The part finding control algorithm for the method of FIG. 10 would change to closing the jaws fully in step 70 and opening the jaws until the part is found in step 82. With the proper jaw design, automatic production of mixtures of parts requiring inside and outside clamping can be achieved with the vise of the present disclosure.

In the preceding specification, the present invention has been described with reference to specific exemplary embodiments thereof. It will, however, be evident that various modifications and changes may be made thereunto without departing from the broadest spirit and scope of the present invention as set forth in the claims that follow. The specification and drawings are accordingly to be regarded in an illustrative rather than restrictive sense.

What is claimed is:

1. A vise for holding a workpiece in a forming machine, comprising:

a moveable jaw moveable between an open position and a clamp position, whereby the moveable jaw allows a workpiece to be positioned in the vise in the open position and the moveable jaw clamps the workpiece in the vise in the clamp position;

a gross moveable jaw drive connected to the moveable jaw and operable to actuate the moveable jaw between the open position and the clamp position, the gross moveable jaw drive comprising a lock selectively restricting a movement of the moveable jaw toward the open position; and a fine moveable jaw drive connected to the moveable jaw and operable to actuate the moveable jaw between the open position and the clamp position, whereby the gross moveable jaw drive is operable to actuate the moveable jaw to a near clamp position and the fine moveable jaw drive is operable to actuate the moveable jaw from the near clamp position to the clamp position to hold the workpiece during a forming operation;

wherein the lock is moveable between an unlock position allowing the gross moveable jaw drive to actuate the moveable jaw between the open position and the clamp position, and a lock position restricting a movement of the moveable jaw toward the open position within one of a plurality of gross increments, and wherein the fine moveable jaw drive is operable to actuate the moveable jaw within one of the plurality of gross increments.

2. The vise of claim 1, wherein the gross moveable jaw drive comprises a drive screw and the lock comprises an inefficiency in the drive screw, whereby the inefficiency in the drive screw prevents back-driving of the gross moveable jaw drive to restrict a movement of the moveable jaw toward the open position.

3. The vise of claim 1, wherein the fine moveable jaw drive comprises a pneumatic moveable jaw drive.

4. The vise of claim 1, wherein the fine moveable jaw drive comprises a hydraulic moveable jaw drive.

5. The vise of claim 1, wherein the gross moveable jaw drive comprises a drive gear.

6. The vise of claim 5, wherein the lock restricts movement of the drive gear in the lock position.

7. The vise of claim 1, further comprising:

a controller communicatively connected to the gross moveable jaw drive to allow the controller to control an actuation of the gross moveable jaw drive.

8. The vise of claim 7, further comprising:

a proximity sensor positioned to detect a preset position of the moveable jaw relative to the workpiece, the proximity sensor communicatively connected to the controller, the controller ceasing actuation of the gross moveable jaw drive if the proximity sensor detects the preset position of the moveable jaw relative to the workpiece.

9. The vise of claim 7, further comprising:

a motor sensor operable detect the when the moveable jaw has contacted the workpiece.

10. The vise of claim 9, wherein the motor sensor comprises:

a motor load sensor operable to detect a motor load, the motor load sensor communicatively connected to the controller, the controller ceasing actuation of the gross moveable jaw drive if the motor load sensor detects that the moveable jaw has contacted the workpiece.

11. The vise of claim 7, further comprising:

an input communicatively connected to the controller, the controller configured to receive via the input a workpiece dimension to be clamped by the vise, the controller ceasing actuation of the gross moveable jaw drive when the moveable jaw reaches the near clamp position, whereby the fine moveable jaw drive is operable to actuate the moveable jaw from the near clamp position to the clamp position to hold the workpiece during a forming operation.

12. The vise of claim 1, wherein the moveable jaw comprises a moveable jaw assembly comprising a moveable jaw carriage and a moveable jaw moveable by the fine moveable jaw drive relative to the moveable jaw carriage, the lock operable to restrict movement of the moveable jaw carriage while movement of the moveable jaw relative to the moveable jaw carriage via the fine moveable jaw drive is still allowed.

13. The vise of claim 1, wherein the gross moveable jaw drive comprises a drive gear having a plurality of teeth, and wherein the lock comprises a pawl moveable into locking engagement with the plurality of teeth.

14. The vise of claim 1, wherein the lock comprises a torque coupling.

15. The vise of claim 1, further comprising:

a stationary jaw, the moveable jaw clamping the workpiece with the moveable jaw and the stationary jaw in the clamp position.

16. The vise of claim 15, wherein a jaw opening is defined between the stationary jaw and the moveable jaw, the workpiece positioned in the jaw opening in the clamp position.

17. The vise of claim 1, further comprising a second jaw, wherein the moveable jaw is moved away from the second jaw to position the vise from the open position to the clamp position.

18. The vise of claim 1, wherein the moveable jaw comprises a plurality of moveable jaws.

* * * * *